United States Patent [19]

Bouffard et al.

[11] 4,414,530

[45] Nov. 8, 1983

[54] MINIATURE MOTOR PROTECTOR APPARATUS AND METHOD FOR ASSEMBLING THEREOF

[75] Inventors: Michael L. Bouffard, Smithfield, R.I.; Radi Pejouhy, Marshfield, Mass.

[73] Assignee: Texas Instruments Incorporated, Dallas, Tex.

[21] Appl. No.: 276,226

[22] Filed: Jun. 22, 1981

[51] Int. Cl.[3] ..... H01C 7/02

[52] U.S. Cl. ..... 338/25; 338/22 R; 338/220; 338/320

[58] Field of Search ..... 338/25, 22 R, 22 SD, 338/220, 260, 320; 318/471

[56] References Cited

U.S. PATENT DOCUMENTS

| | | | |
|---|---|---|---|
| 3,737,752 | 6/1973 | Strachan | 318/471 |
| 3,914,727 | 10/1975 | Fabricius | 338/220 X |
| 3,921,117 | 11/1975 | Blaha | 338/220 |

*Primary Examiner*—C. L. Albritton

*Attorney, Agent, or Firm*—John A. Haug; James P. McAndrews; Melvin Sharp

[57] ABSTRACT

A miniature, solid state motor protector has a metallic housing with two hingedly connected recessed portions with a wafer of positive temperature coefficient (PTC) of resistivity material disposed in each recess in electrical connection with the housing and a center spring contact located intermediate the two PTC wafers and in electrical connection therewith so that the wafers are electrically connected in parallel relation.

13 Claims, 10 Drawing Figures

MINIATURE MOTOR PROTECTOR APPARATUS AND METHOD FOR ASSEMBLING THEREOF

BACKGROUND OF INVENTION

This invention relates to motor protectors and more particularly to a device which can be used to control the energization of a small, low current, intermittent duty motor such as that used to operate door locks in automobiles. It is conventional in such applications to use very small motors, typically an inch or less in diameter by less than two inches in length, twelve volt, direct current, permanent magnet, and electrically reversible. These motors are designed to move an actuator of given weight, e.g. 2.27 Kg, a certain distance within a selected time period. When the actuator moves to its extremity in either direction the rotor will be locked. If the manually actuated switch is still energized, as by a door lock button which sticks, the motor is then deenergized by some type of current interrupting device. Current interrupting devices comprising a bimetallic member which moves to separate electrical contacts to open the motor circuit are known but have not been fully satisfactory when used with these small motors. Such devices are relatively expensive and have limited service life since they have moving parts. Further it has been found to be virtually impossible to adequately protect the motor due to the limited snap action motion as a result of the constraints of space. As a result, nuisance trips are likely to occur due to the contacts creeping open. This causes fast cycling under locked rotor conditions and ultimately untimely motor failure. Another problem occurs when calibration of the device is adversely affected by shocks such as those produced by slamming of the door over the life of the device.

A solid state PTC protector, since it has no moving parts, is not subject to the above noted deficiencies however due to the small size of the motor as well as the small volume of space available for such a device none have heretofore been available for this purpose. A typical motor of this type is rated as 0.005 horsepower or 0.4 watts. Conventional PTC devices are too massive to provide the required cycle timing, i.e., it takes too long for a conventional PTC device to reach its reset temperature once it goes above its anomaly temperature, or it has too high a base resistance for the motor with which it is to be serially connected as in the case of ceramic PTC, or it has too low an anomaly temperature for the elevated temperature in the automotive environment as in the case of polymer PTC, i.e., the PTC would reset too quickly.

It is therefore an object of the invention to provide a motor protector which is particularly well suited for use with low current motors, in the order of 8 amps, 12 volt DC, which in normal operation runs in one direction until an actuator moved by the motor reaches a limit and a manually actuated switch is deactuated. The motor protector's function is to deenergize the motor when it goes into the locked rotor condition before the motor is damaged from overheating. Then, after the motor protector cools sufficiently to reset, the motor can be energized to move the actuator in the opposite direction until another limit is reached. The motor goes into locked rotor condition in every cycle but normal switch operation should allow use of a door lock without operation of the protector. However, if the button sticks or is held in an actuated position for an excessively long period of time, the motor will overheat due to the locked rotor so that the selection of the motor protector is very critical particularly with regard to matching the protector's characteristics to the temperature characteristic of the motor. It is an object of the invention to provide such a protector which can be readily manufactured using efficient, mass production techniques. Yet another object is the provision of a protector which is inexpensive yet has a long life expectancy.

Other details, uses and advantages of the invention will be readily apparent from the exemplary embodiment thereof presented in the following specification, claims and drawings.

In accordance with the invention the objects are realized by mounting two wafers of ceramic PTC material approximately 0.33–0.36 mm in thickness, each having a base resistance of approximately 0.6 ohms, and connecting them in parallel circuit relationship in a package which has minimal mass. The package comprises a housing formed out of suitable material such as a sheet of cold rolled steel approximately 0.36 to 0.40 mm in thickness formed into top and bottom portions each having a recess and with the two portions connected together but hinged so that the sheet can be bent back on itself with the recesses in aligned facing relationship with one another forming a switch cavity. The housing is held so that one recess faces upwardly, the other portion is bent upwardly approximately 90°, a first PTC wafer is placed in the upwardly facing recess, a center spring contact plate having a plurality of wafer contacting surfaces struck therefrom on two opposite faces of the plate is placed on top of the wafer and a second PTC wafer is placed on top of the center contact plate. Apertures are provided in the side walls of the housing extending into the top and bottom walls to allow access of positioning fingers which locate the wafers and center contact as desired relative to the housing. The portion of the housing that had previously been bent upwardly is then bent all the way over until welding tabs extending from that portion come into contact with welding projections formed on a ledge extending from the first portion and the housing is welded together. Protrusions are formed in the housing and the spring contact plate to engage the PTC wafers and are so located that three protrusions in the housing are in alignment with three protrusions on the spring contact plate for each wafer so that no torsional forces are imparted to the wafers while at the same time effective electrical contact is achieved.

Placement of the center contact plate between the two portions of the housing results in spacing the two portions from one another along the sides of the housing to provide extra ventilation as well as making the fitting of the two portions together less critical compared to conventional two part housings which fit closely together. The center contact plate is provided with strengthening ribs which are disposed at such an angle that they, along with angled side walls of the housing, prevent shorting across the wafer even in the event that a wafer moves into physical contact with a rib or side wall.

Three contact fingers struck from the center plate are bent from the plane of the plate in one direction a selected distance while a pair of contact fingers, also struck from the center plate, are bent from the plane of the plate in the opposite direction a lesser distance and cooperate with a protrusion formed in the body of the center plate to make electrical contact with the wafers.

A pair of gaskets are placed over an end of the center contact plate with one gasket having a preformed depressed area surrounding apertures which depressed areas fit into mating apertures in the center contact plate and over the weld projections on the housing ledge so that any flash occasioned by the welding operation will not form a bridge between the housing and the center contact plate.

BRIEF DESCRIPTION OF THE DRAWINGS

Reference is now made to the accompanying drawings showing a preferred embodiment of a motor protector according to the invention in which.

Figure 6:
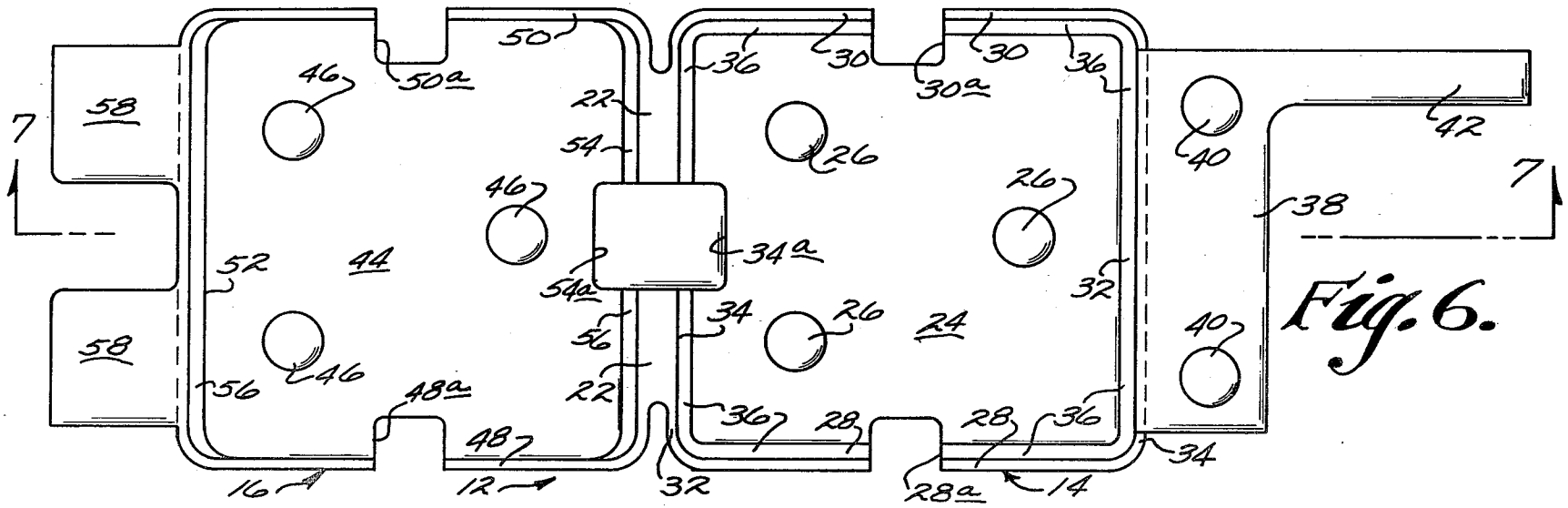
FIG. 6 is a top plan view of a housing used for the protector but prior to the bending of one portion relative to the other.
Figure 7:
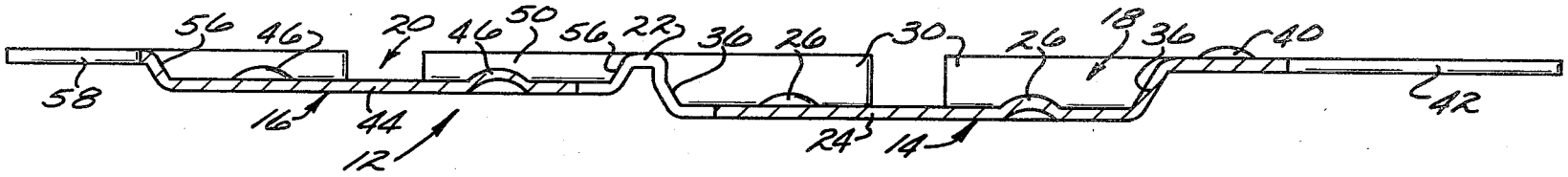
FIG. 7 is a cross sectional view taken on line 7—7 of FIG. 6.

With reference to the drawings numeral 10 generally designates a motor protector made in accordance with the invention. Motor protector 10 comprises a housing 12 having a bottom portion 14 and a top portion 16. As best seen in FIGS. 6 and 7 housing 12 is preferably formed from a sheet of structurally strong, electrically conductive material such as cold rolled steel, approximately 0.36 to 0.40 mm in thickness. The steel sheet is preferably nickel or tin plated. It will be understood that the housing could be formed of other suitable material, such as brass, a steel-copper-steel composite, or the like. A recess 18 is formed in bottom portion 14 and a corresponding recess 20 is formed in top portion 16. Hinge portions 22 join bottom portion 14 to top portion 16 so that the sheet can be bent back upon itself with recesses 18 and 20 in aligned facing relationship to form a single switch cavity.

Bottom portion 14 has a generally rectangular bottom wall 24 in which a plurality of protrusions 26 extending into recess 18 are formed. Although any particular number of protrusions may be provided, it is preferred to have three for more consistent contact force, as will be explained in more detail below. As seen in FIG. 6 two protrusions are equidistant from the longitudinal axis of hinge portions 22 while a third protrusion is disposed intermediate the first two but spaced further from the longitudinal axis of hinge portions 22. Opposed side walls 28 and 30 extend upwardly from bottom wall 24 as do end walls 32 and 34. Side and end walls 28–34 are all formed with a bevel 36 of approximately 30 degrees, the particular angle being a matter of choice, for a purpose to be described below. A ledge 38 extends laterally away from the free end of wall 34 and has a pair of welding projections 40 extending upwardly therefrom and a terminal 42 extending laterally from one side of the ledge. A portion of side walls 38 and 30 and end wall 34 are cut away at 28*a*, 30*a*, and 34*a* respectively, the cuts extending into bottom wall 24 to permit access into recess 18 during assembly of the device as will be described below.

Top portion 16 of housing 12 has a generally rectangular top wall 44 in which a plurality of protrusions 46 extending into recess 20 are formed. It is preferred to provide the same number of protrusions as in the bottom portion 14 and to so locate them that when the two portions are bent together, the protrusion in the top wall will be out of alignment with protrusions in the bottom wall. Thus a pair of protrusions 46 are equidistant from the longitudinal axis 22 but the same distance as the centrally disposed protrusion 26 from the axis while a single protrusion 46, disposed intermediate the pair of protrusions 46, is located the same distance from the longitudinal axis of hinges 22 as are the pair of protrusions 26.

Opposed side walls 48 and 50 extend upwardly from bottom wall 44 as do end walls 52, 54. End walls 52 and 54 are both formed with a bevel 56 which may be formed with the same angle as bevel 36 of bottom portion 14. However, side walls 48 and 50 need not be beveled for a reason to be explained below. A pair of welding tabs 58 extend laterally from the free end of end wall 52 and are located so that they will be in alignment with welding projection in ledge 38 when portions 14 and 16 are bent together. Side walls 48 and 50 as well as end wall 54 are cut away at 48*a*, 50*a*, and 54*a* with the cut extending into top wall 44 and so located that they will be in alignment with a respective cut away portion in portion 14 when the portions are bent together. That is, cut away portions 30*a* and 50*a*, 28*a* and 48*a*, and 34*a*, 54*a* will form three cut away portions of housing 12 which extend from the top wall 44 all the way through bottom wall 24.

Figure 8:
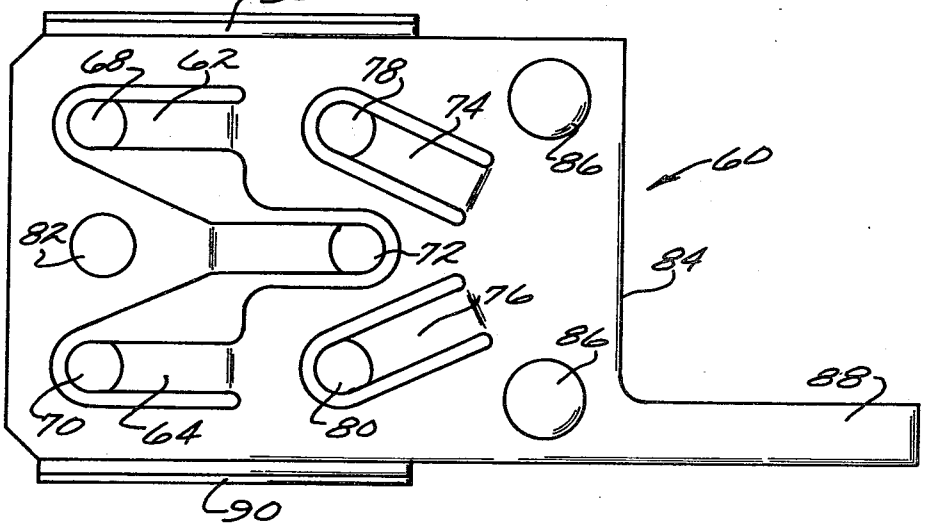
FIG. 8 is a top plan view of a center contact plate use in protector 10.
Figure 9:
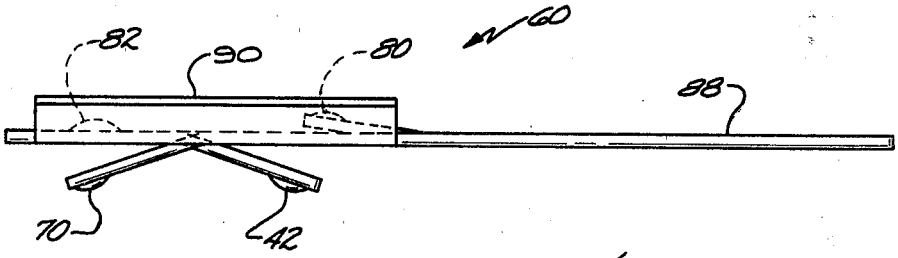
FIG. 9 is a front elevational view of the FIG. 8 contact plate.

A center contact 60 is formed from a sheet of material having both good electrically conductive characteristics and good spring characteristics such as a phospher bronze approximately 0.425–0.464 mm in thickness. As seen in FIGS. 8 and 9 center contact plate 60 is generally rectangular in configuration and has three spring fingers 62, 64, 66 struck from the center contact plate and bent in one direction (down as seen in FIG. 8) away from the plane of the contact plate. A respective rounded protrusion 68, 70, 72 is formed on the outer free end of each finger. Protrusions 68, 70 and 72 are located so that when center contact plate 60 is assembled in housing 12 they will be facing alignment with protrusions 26 in bottom portion 14. Also struck from the center contact plate are fingers 74, 76. Fingers 74, 76, with protrusions 78, 80 respectively formed at their distal free end are bent away from the plane of the center contact plate in the opposite direction from that of fingers 62, 64, 66. A third protrusion 82 is formed in the body of the center contact plate at the base of finger 66.

Extending laterally from contact plate 60 is a mounting ledge 84 having a pair of apertures 86 located so that they will be in alignment with welding projections 40 when center contact plate 60 is assembled in housing 12. A terminal 88 extends laterally from a side of ledge 84 so that when contact plate 60 is assembled in housing 12 terminal 88 will be spaced from terminal 42.

On two opposite sides of center contact plate 60 a lip 90 extends upwardly from the plane of the contact plate, on the side from which protrusion 82 projects, at an angle of approximately 22° from the vertical, or at an obtuse angle relative to the plane of plate 60.

Fingers 74, 76, located closer to mounting ledge 84 then fingers 62–66 are not bent as far out of the plane of the contact plate as are fingers 62–66.

Protrusions 78, 80 and 82 are located such that when center contact plate 60 is assembled in housing 12 they will be in aligned facing relation with protrusions 46 in portion 16 of the housing.

In addition to housing 12 and center contact plate 60 protector 10 includes a pair of generally rectangular resistive wafers 92 made of a ceramic material having a positive temperature coefficient (PTC) of resistivity. In order to obtain the necessary low resistance at temperatures below the anomaly the thickness of each wafer 92 is approximately 0.33 to 0.36 mm. Wafers 92 are composed of barium titanate doped with a rare earth such as lanthanum or other elements or mixtures thereof and are provided with electrically conductive coatings on opposite faces thereof. The conductive coatings are conventional such as electroless nickel plated with silver.

Isolation between housing 12 and center contact plate 60 is achieved by means of gaskets 94 and 96. Gaskets 94 and 96 are formed out of any suitable electrically insulative material such as Nomex, a trademark of E. I. du Pont de Nemours Co. for nylon fiber paper board material. Gaskets 94 and 96 are each approximately 0.15 mm in thickness and extend beyond ledge 38 and welding tabs 58 in length as well as in width. Gasket 94 is provided with two apertures, each in alignment with a weld projection 40 on ledge 38 and apertures 86 in contact plate 60. The apertures are smaller than apertures 86 in contact plate 60 as well as being smaller than the diameter of weld projection 40. Preferably gasket 94 is preformed with a depressed area around each aperture so that it fits over the weld projection to provide an electrically insulating layer along much of the surface of the weld projection (see FIG. 3). Gasket 96 is also provided with an aperture for each weld projection 40, the apertures having a diameter smaller than apertures 86 of the center contact to ensure that there is no electrical engagement between the housing and the center contact, but somewhat larger than the apertures in gasket 94 which is made smaller to provide coverage of the surface of the weld projection. Thus any flash which might occur when welding the top and bottom portions of the housing together is prevented from making a bridging connection between the housing and center contact 60.

Figure 1:
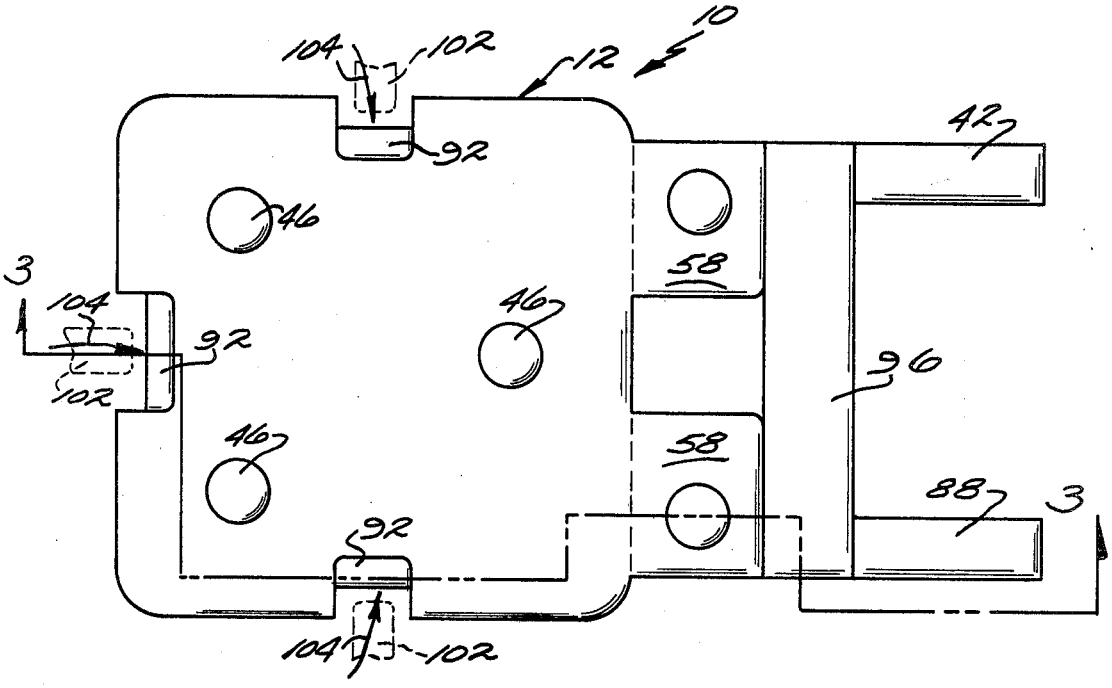
FIG. 1 shows a top plan view of a motor protector 10.
Figure 2:
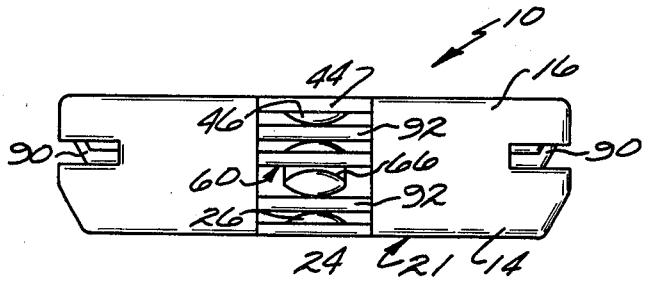
FIG. 2 is an end view of the FIG. 1 protector.
Figure 3:
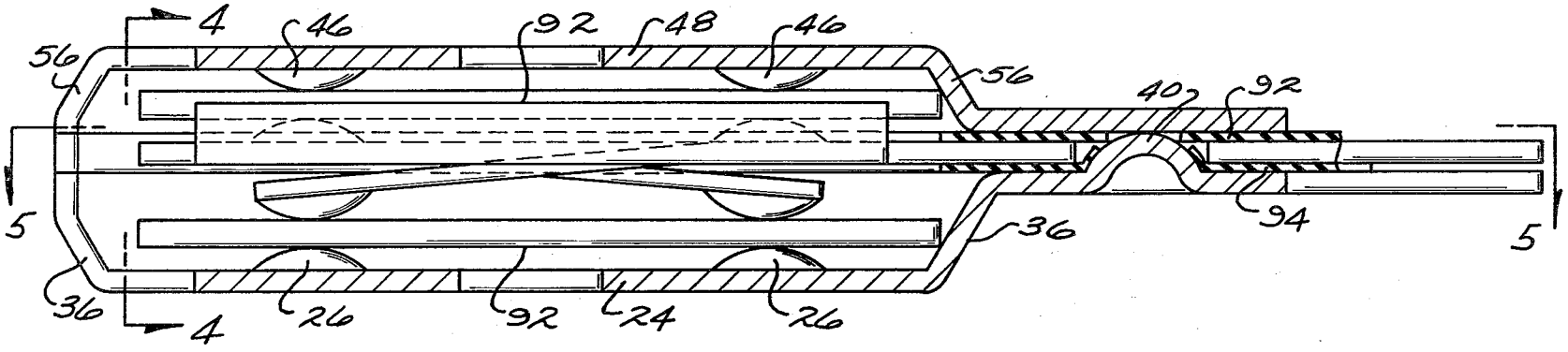
FIG. 3 is a cross sectional view taken on line 3—3 of FIG. 1.
Figure 4:
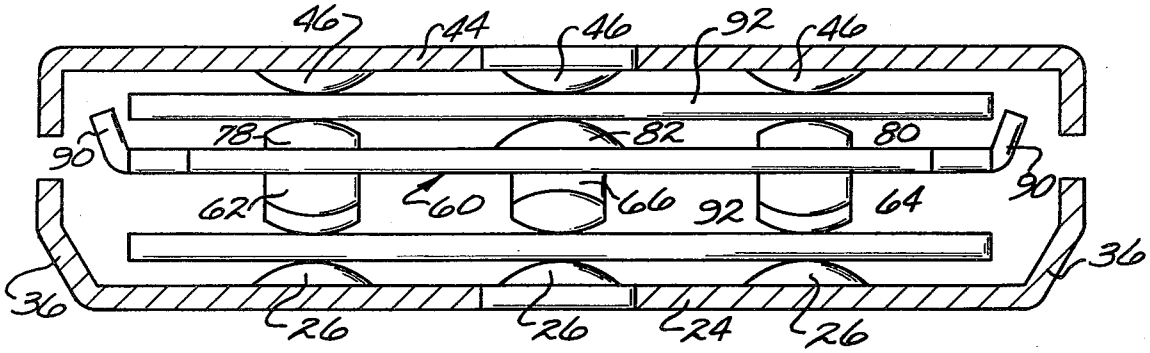
FIG. 4 is a cross sectional view taken on line 4—4 of FIG. 3.
Figure 5:
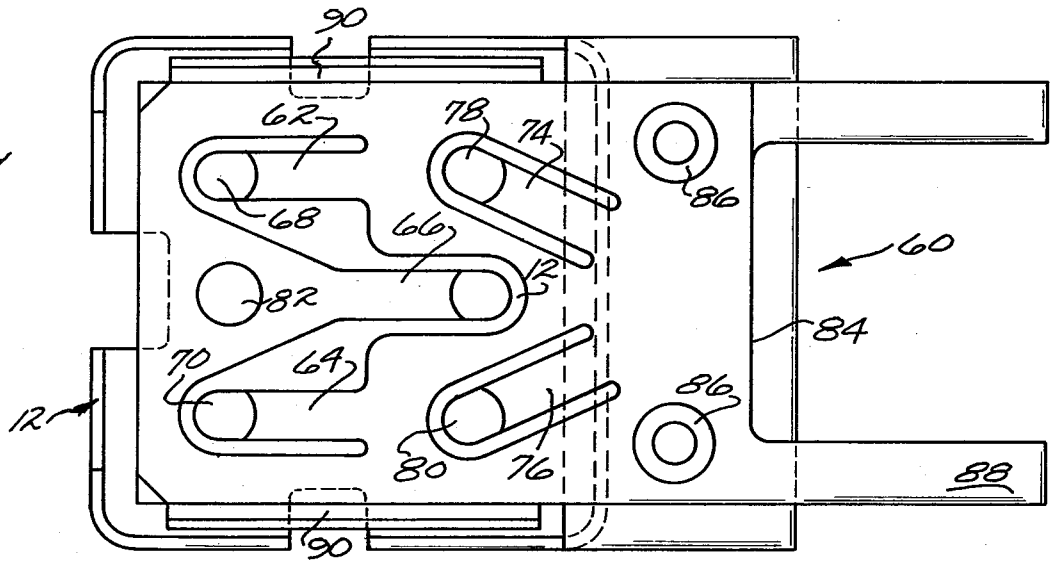
FIG. 5 is a cross sectional view taken on line 5—5 of FIG. 3.

With particular reference to FIGS. 3 and 4 it will be seen that provision of bevel surfaces 36 and 56 effectively precludes shorting across the wafers 92 even when one contacts a wall of the housing as shown in FIG. 3 on the righthand side of each wafer 92. The beveled surface of lips 90 of center contact plate 60 not only provide structural rigidity to the center contact plate, they also prevent short circuiting across the wafer the event that the side edge of a wafer comes into engagement with a center contact lip.

Figure 10:
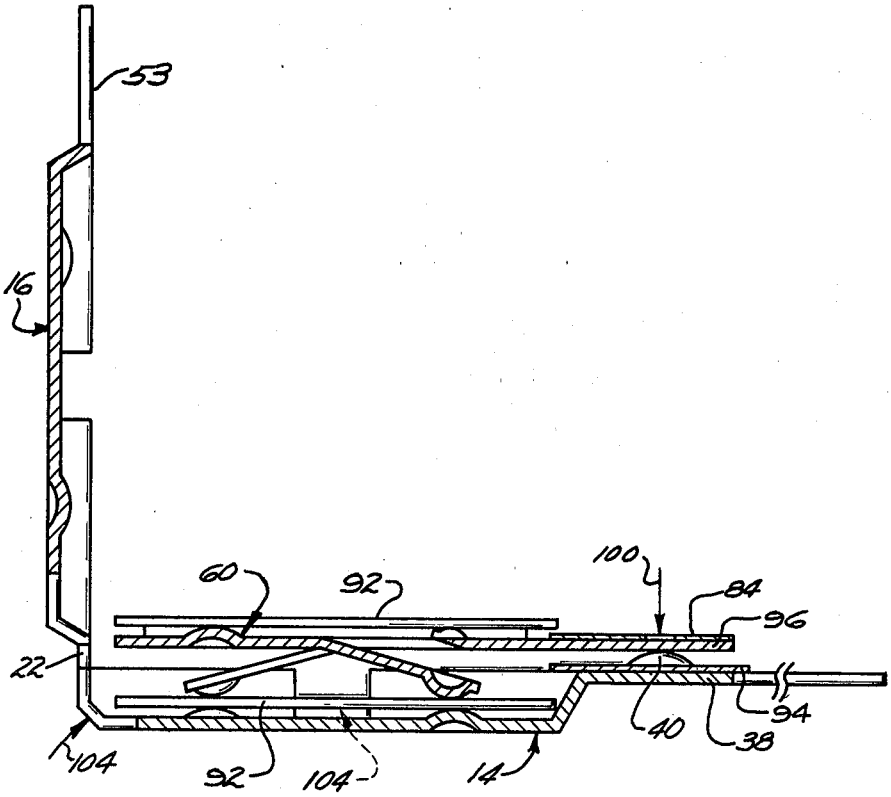
FIG. 10 is a cross sectional front view of protector 10 during its assembly operation.

A protector made in accordance with the invention is easily manufactured using mass manufacturing techniques. The housing is stamped out of a base metal sheet and at the same time is formed with recesses 18 and 20 and protrusions 26 and 46 and cut away portions. With bottom portion 14 held by any suitable means top portion 16 is bent upwardly approximately 90° as seen in FIG. 10. Gasket 94 is placed on ledge 38 with the apertures leaving the central portion of weld projections 40 exposed. A wafer 92 is dropped into recess 18, center contact plate 60 is placed over the wafer in recess 18 with gasket 96 placed on ledge 84. A downwardly directed force, as indicated by arrow 100, is exerted on the ledges through gasket 96 and in a location which would be between welding tabs 58 when portion 16 is bent all the way over, to hold the center contact in its desired location. A second PTC wafer 92 is placed on top of center contact plate 60 and tools 102 (see arrows 104) are brought into engagement with the internal assembly to locate them (the PTC wafers and the center contact) in their selected location. Placement of the components may be abetted by use of vibration if desired. Top portion 16 is then folded over and weld projections 40 welded to welding tabs 58 to complete the assembly.

PTC wafers 92, connected in parallel, result in an effective electrical resistance of protector 10 of approximately 0.25 ohms which allows normal operation of the 0.005 horsepower motor. The small mass of the wafers, as well as that of housing 12 along with the contacting system employed provides the desired switching time. If it is desired to further decrease the switching time, additional portions of housing 12 may be cut away as needed.

As various changes could be made in the above protector and method of assembling it without departing from the scope of the invention, it is intended that all matter contained in the above description or shown in the accompanying drawings shall be interpreted as illustrative and not in a limiting sense.

We claim:

1. A motor protector particularly suitable for use with a low current, intermittent duty motor comprising a metallic housing having top and bottom wall surfaces, and having a terminal extending from one of the surfaces, the housing comprising a sheet having first and second portions with a first recess formed in the first portion and a second recess formed in the second portion, the first and second portions being integrally connected and hinged together, first and second PTC wafers, the first wafer in physical and electrical engagement with the top wall surface, the second wafer in physical and electrical engagement with the bottom wall surface, an electrically conductive center contact disposed between the first and second PTC wafers and in physical and electrical engagement therewith, the center contact having a terminal extending therefrom beyond the top and bottom wall surfaces of the housing and electrically insulative material placed between the center contact and the housing.

2. A motor protector according to claim 1 in which a plurality of dimples are formed in the top and bottom wall surfaces, the dimples extending into the housing.

3. A motor protector particularly suitable for use with a low current, intermittent duty motor comprising a metallic housing having top and bottom wall surfaces, a plurality of dimples formed in the top and bottom wall surfaces, the dimples extending into the housing, the housing having a terminal extending from one of the surfaces, first and second PTC wafers, the first wafer in physical and electrical engagement with the top wall surface, the second wafer in physical and electrical engagement with the bottom wall surface, an electrically conductive center contact disposed between the first and second PTC wafers and in physical and electrical engagement therewith, the center contact being substantially plate like and having a plurality of fingers cut out of the plate, the fingers bent to extend out of the general plane of the plate both above and below the plate, each finger having a free distal end adapted to engage one of the PTC wafers, the center contact having a terminal extending therefrom beyond the top and bottom wall surfaces of the housing and electrically insulative material placed between the center contact and the housing.

4. A motor protector according to claim 3 in which three fingers extend upwardly from the plate and two fingers extend downwardly from the plate and a dimple is formed in the plate extending downwardly therefrom, the free distal end of the fingers and the dimple in the plate being in alignment with the dimples formed in the top and bottom wall surfaces.

5. A motor protector according to claim 4 in which the three upwardly extending fingers project further away from the plate than do the two downwardly extending fingers.

6. A motor protector according to claim 5 in which the dimple formed in the plate is further removed from the terminal of the plate than the two downwardly extending fingers.

7. A motor protector according to claim 1 in which a plurality of apertures are formed in the housing to provide access for a tool to engage and position the wafers and center contact plate.

8. A motor protector according to claim 1 in which the top wall has a ledge extending therefrom and the bottom has welding tab means extending therefrom in alignment with the top wall ledge, and a ledge extends from the center contact and is disposed between the top wall ledge and the welding tab means and electrically insulative strips are disposed between the center contact ledge and both the top wall ledge and the welding tab means.

9. A motor protector according to claim 8 in which the center contact ledge has a bore therethrough, a weld projection extends from the top wall ledge through the bore and is welded to the tab weld means.

10. A motor protector according to claim 9 in which bores are provided in the insulative strips in alignment with the center contact bores, the bore in at least one of the strips having a diameter substantially smaller than the diameter of the center contact bores so that electrical insulation is interposed between the weld projection and the side wall defining the center contact bore.

11. A motor protector particularly suitable for use with a low current, intermittent duty motor comprising a metallic housing having top and bottom wall surfaces, and having a terminal extending from one of the surfaces, first and second PTC wafers, the first wafer in physical and electrical engagement with the top wall surface, the second wafer in physical and electrical engagement with the bottom wall surface, the housing being formed with side walls which are beveled so that physical contact of a PTC wafer with a beveled side wall will result in contact with only face of the wafer, an electrically conductive center contact disposed between the first and second PTC wafers and in physical and electrical engagement therewith, the center contact having a terminal extending therefrom beyond the top and bottom wall surfaces of the housing and electrically insulative material placed between the center contact and the housing.

12. A motor protector according to claim 11 in which the center contact is provided with strengthening lips, the lips extending from the center contact plate at an obtuse angle so that physical contact of a PTC wafer with a lip will result in contact with only one face of the wafer.

13. A motor protector particularly suitable for use with a low current, intermittent duty motor comprising an electrically conductive metallic housing sheet formed into first and second recessed wall portions hingedly joined together and adapted to be folded so that the first and second recessed wall portions are in facing alignment with each other, first and second resistive wafers formed of a positive temperature coefficient (PTC) of resistivity material, an electrically conductive metallic center contact plate formed of material having good spring characteristics and lying in a plane, a plurality of fingers defined in the contact plate and extending out of the plane of the center contact plate on two opposite sides, the PTC wafers having an electrically conductive layer on two spaced surfaces thereof, the PTC wafers disposed within the folded housing sheet so that a conductive layer of the first PTC wafer is in physical contact with the first recessed wall portion, and a conductive layer of the second PTC wafer is in physical contact with the second recessed wall portion, and the center contact sheet is sandwiched between the other conductive layers of the PTC wafers, a terminal portion extending from one portion of the housing sheet and from the center contact plate, welding tabs extending from the other portion of the housing sheet, respective electrically insulative members disposed between the welding tabs and the center contact plate and between the center contact plate and the one portion of the housing sheet.

* * * * *